US006116620A

United States Patent [19]

Gabrielli

[11] Patent Number: 6,116,620

[45] Date of Patent: Sep. 12, 2000

[54] ROLLER SKATE HAVING AN ITEM OF FOOTWEAR AND A ROLLER-CARRYING CARRIAGE WHOSE POSITIONS CAN BE ALTERED RELATIVE TO ONE ANOTHER

[75] Inventor: Andrea Gabrielli, Predazzo, Italy

[73] Assignee: Tecnica SpA, Treviso, Italy

[21] Appl. No.: 09/086,289

[22] Filed: May 29, 1998

[30] Foreign Application Priority Data

Jun. 13, 1997 [IT] Italy ..... TV97A0078

[51] Int. Cl.[7] ..... A63C 17/00

[52] U.S. Cl. ..... 280/11.19; 280/11.2; 280/11.22; 280/11.23; 280/11.27; 280/11.3; 280/11.31

[58] Field of Search ..... 280/11.3, 11.22, 280/11.2, 11.27, 11.31, 11.23, 11.19, 11.13

[56] References Cited

U.S. PATENT DOCUMENTS

| | | | |
|---|---|---|---|
| 5,388,846 | 2/1995 | Gierveld . | |
| 5,437,466 | 8/1995 | Meibock | 280/11.22 |
| 5,452,907 | 9/1995 | Meibock . | |
| 5,823,545 | 10/1998 | Goeckel | 280/11.22 |
| 5,855,383 | 1/1999 | Harr et al. | 280/11.19 |
| 5,899,465 | 5/1999 | Mayer | 280/11.2 |
| 5,918,889 | 6/1999 | Tai | 280/11.22 |
| 5,961,132 | 10/1999 | Post | 280/11.27 X |
| 5,971,406 | 10/1999 | Lyman | 280/11.22 |

FOREIGN PATENT DOCUMENTS

95/35136 12/1995 WIPO .

*Primary Examiner*—Michael Mar
*Assistant Examiner*—Toan To
*Attorney, Agent, or Firm*—Birch Stewart Kolasch & Birch, LLP

[57] ABSTRACT

A roller skate, of the type having a carriage or frame on which a series of running rollers is arranged in a freely rotatable manner, the frame being provided with a device for fastening to the rigid sole of an item of footwear which is temporarily releasable to enable the position of the footwear and the carriage relative to one another to be altered. The fastening device has a pair of substantially stationary cross-members, each of which accommodates rotatable cam means which are connected eccentrically at the top to the rigid sole of the footwear in order to adjust the position thereof with respect to the carriage and to fasten it in the desired position.

12 Claims, 9 Drawing Sheets

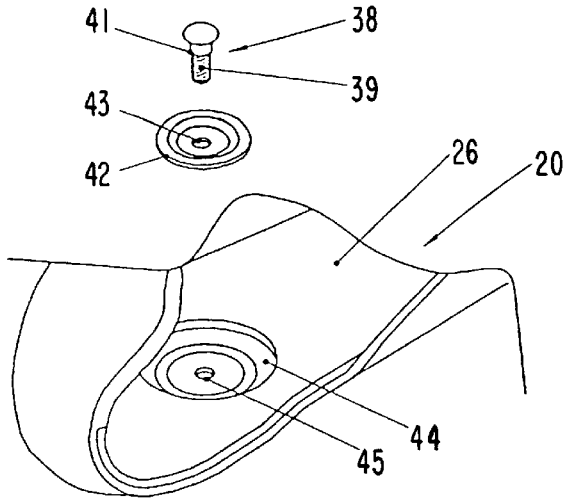
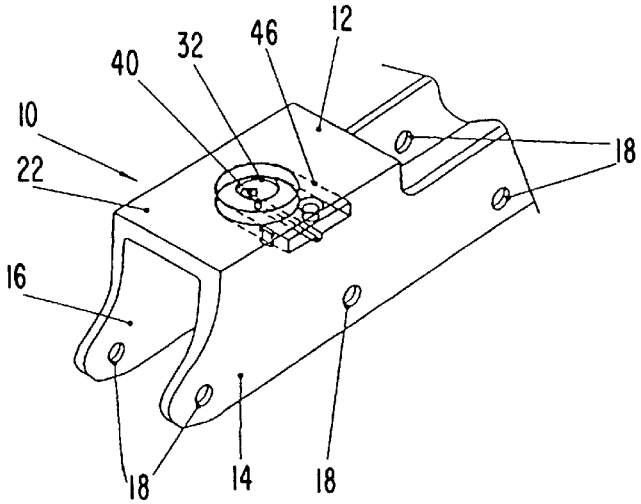
FIG. 9
FIG. 10
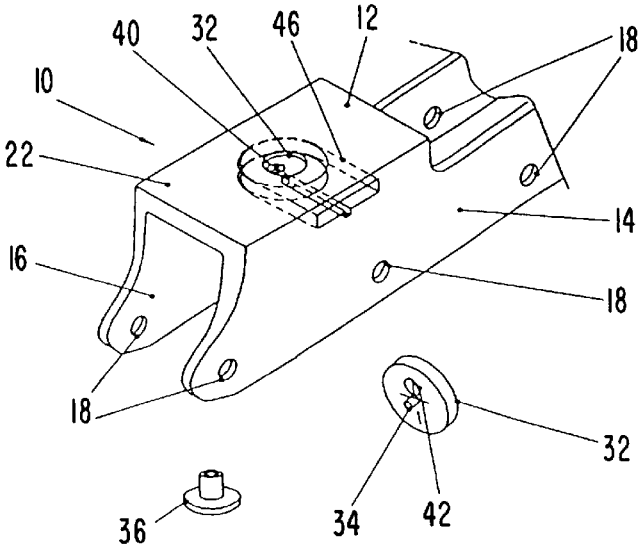
FIG. 11

ROLLER SKATE HAVING AN ITEM OF FOOTWEAR AND A ROLLER-CARRYING CARRIAGE WHOSE POSITIONS CAN BE ALTERED RELATIVE TO ONE ANOTHER

The present invention relates to a roller skate in which the footwear is fastened to the roller-carrying carriage by means of locking means which enable the position of the footwear and the carriage relative to one another to be altered.

Purely for the sake of simplicity and brevity, the present description will refer to a roller skate of the so-called "in-line" type but this reference is of course not to be understood as limiting the invention.

Merely for the sake of completeness of reference, it should be noted that the present invention can be extended, without changing its innovative concept, for example, to bladed skates for use on ice, and in general to footwear having a rigid sole, such as, for example, a ski boot, and having an item of sporting equipment applied to its sole.

BACKGROUND OF THE INVENTION

It is known that the adjustment of the position of the footwear and the roller-carrying carriage or frame relative to one another is one of the basic aspects to which the user attaches particular importance and it is also known to both the manufacturer of that article and to the user that the above-mentioned adjustment is a function which depends directly on various parameters, such as, for example, the greater or lesser experience of the skater and the specific requirements which arise from time to time as a function of the type of route or terrain on which the skates are used. Typical examples of the choices made by the user are the arrangement of the rollers aligned in parallel or disposed along the median longitudinal plane of the footwear or along planes inclined relative to the above-mentioned plane. In other cases, a footwear position which is advanced or moved back relative to the carriage or frame is required.

It is clear that, with reference especially to the type of terrain or route on which the skates are used, consequent changes will be made to the pushing and direction commands which the user has to impart to the roller-carrying carriage by way of the footwear.

Roller skates having locking means that enable the position of the footwear and the roller-carrying carriage relative to one another to be altered are known in various forms because the above-mentioned feature is all-important in guiding users as to their choice of one type of skate rather than another.

The most common disadvantages of conventional skates of that type, the details of which will not be discussed here because the various solutions adopted are numerous, are, by way of example, the narrowness of the possible range of adjustment or the possibility of adjustment in only one direction, such as, for example, the longitudinal direction, or, finally, the complexity of the operations necessary to effect the above-mentioned adjustment which, as will be appreciated, have to be carried out directly by the user. In fact, in the majority of cases, the user finds that it is very difficult and time-consuming to obtain the optimum position of use of the skate.

The main aim of the present invention is to provide a structure of a roller skate, especially an in-line roller skate, which does not have the disadvantages mentioned briefly above.

A more specific aim of the present invention is to provide a roller skate of which the novel configuration and form enable the above-mentioned adjustment to be effected extremely rapidly and in a well defined manner whatever the position desired by the user.

An even more precise aim of the present invention is to provide a roller skate with which only one operation is required for the appropriate positioning of the footwear relative to the frame because, for each adjustment, the necessity for subsequent adjustment, as is necessary in conventional skates, is excluded.

SUMMARY OF THE INVENTION

Those and other aims are achieved with a roller skate as described in detail hereinafter, of the type comprising a carriage or frame on which a series of running rollers is mounted in a freely rotatable manner and which is provided with means of fastening to the rigid sole of an item of footwear which are temporarily releasable in order to alter the position of the footwear and the carriage relative to one another. The fastening means are arranged on a pair of substantially stationary cross-members with which the carriage is provided, and the invention is characterised in that an element for connecting the carriage to the sole of the footwear is associated with each of the cross-members and is connected to the sole eccentrically, the position of the connecting element in the released state being alterable in order to permit movement for adjusting the position of the footwear and the carriage relative to one another, and the connecting element being lockable on the cross-member in order to fasten the footwear and the carriage relative to one another when the desired position has been reached.

The features and advantages of the roller skate according to the present invention will become clear from the following detailed description of two of its non-limiting embodiments which is given with reference to the appended drawings.

BRIEF DESCRIPTION OF THE DRAWINGS

FIG. 9 is an exploded diagrammatic perspective view of the front end of the skate according to the present invention in the first embodiment;

FIG. 10 is a view analogous to FIG. 9 of only the front end of the roller-carrying carriage;

FIG. 11 is a perspective view of only the cam means connecting the carriage to the footwear, still in accordance with the first embodiment;

DESCRIPTION OF PREFERRED EMBODIMENTS

Referring first of all especially to FIGS. 1 to 8, 10 generally indicates the skate carriage or frame on which the running rollers, which are not represented because they are not necessary in order to understand the present invention, are mounted in a freely rotatable manner.

Figure 14:
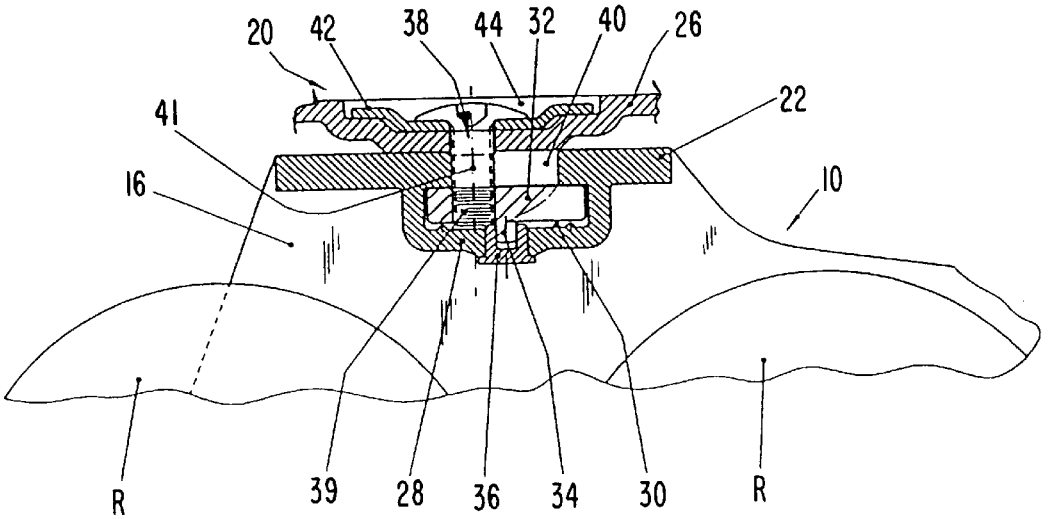
FIG. 14 is a view of the front end of the skate on section A—A of FIG. 12.

As can be seen in more detail by referring also to FIGS. 9 and 10, the frame or carriage 10 comprises, in known manner, a body 12 which is substantially in the form of an inverted U and which therefore has two side limbs 14 and 16 (the two sides of the U) provided with aligned and opposing holes 18 which are used for mounting the hubs (not shown) for the rotation of the running rollers R, two of which are shown partially only in FIG. 14 for sake of clarity.

Referring still to FIGS. 1 to 8, the shape of the footwear generally indicated 20 is shown schematically and with a broken line.

The carriage 10 has, substantially in the vicinity of its ends, two stationary cross-members 22 and 24 which accommodate means for connection to the footwear 20 which, as will be explained hereinafter, are means which fasten the carriage 10 and the footwear 20 relative to one another and which can be temporarily released in order to adjust the mutual positions thereof.

In particular, the above-mentioned Figures illustrate by way of example some of the adjustments permitted by the locking means with which the skate is provided, the others not being illustrated because they are clearly deducible from those represented by the above-mentioned Figures and also because, as will become clearer in the course of the present description, the possible adjustments of the position of the footwear 20 relative to the carriage 10 are effected continuously and therefore any desired mutual positioning can be achieved.

Still referring to FIGS. 1 to 8, a list will now be given hereinafter, Figure by Figure, of the various possible adjustments, the direction of movement of the footwear 20 always being indicated by the arrows, all of which are marked with the letter F and are not differentiated from one another by a reference numeral because their meaning is clear from the representation.

Figure 1:
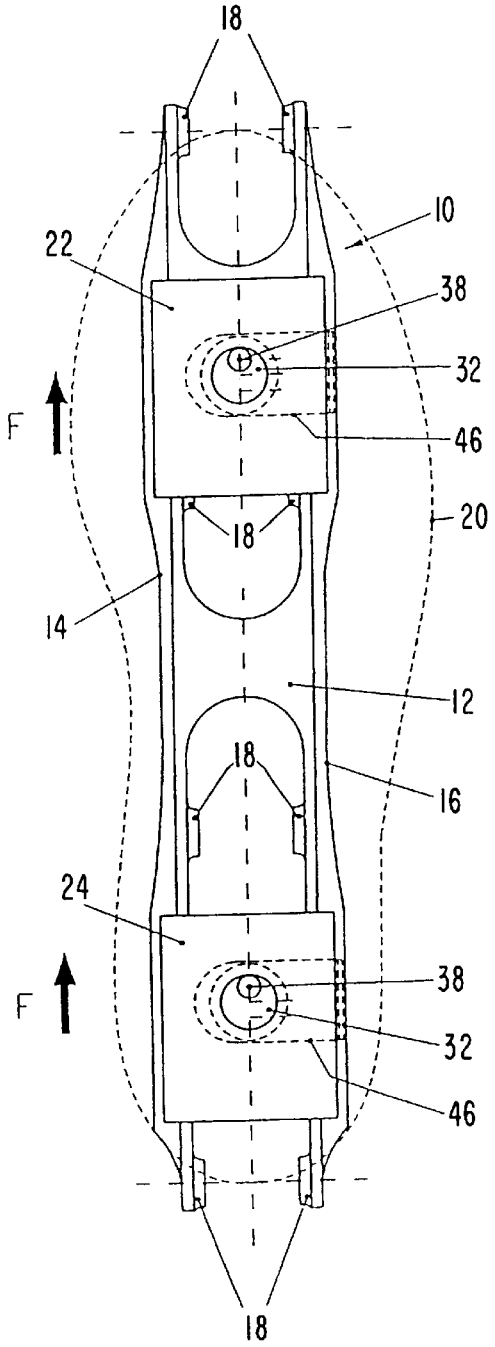
FIGS. 1 to 8 are diagrammatic plan views of the roller-carrying frame in a first embodiment which show, as explained hereinafter, some of the various possible adjustments of the position of the footwear and the carriage relative to one another.
Figure 2:
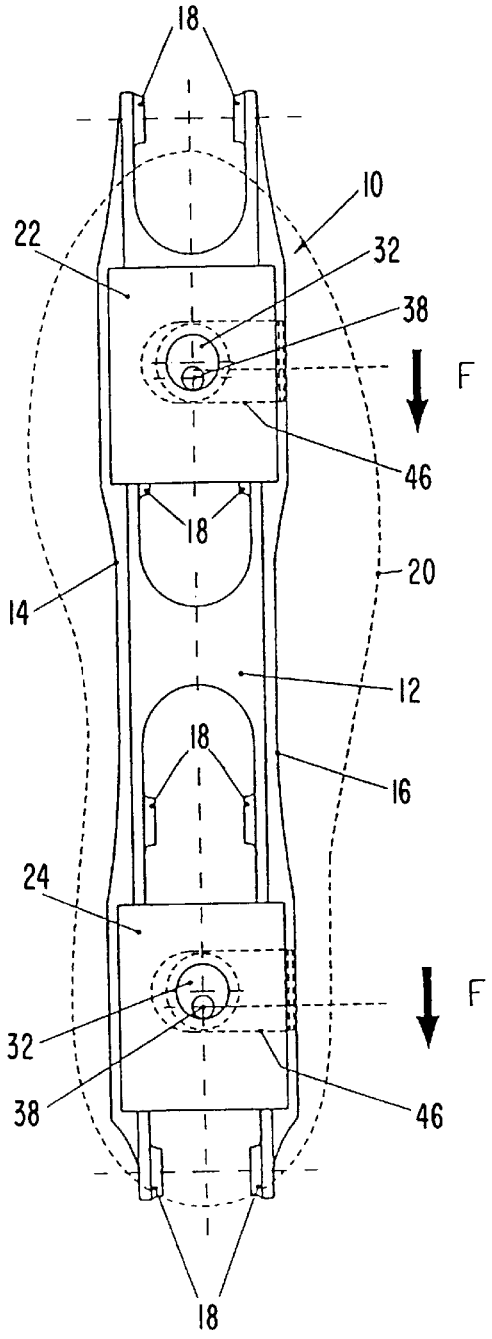
Figure 3:
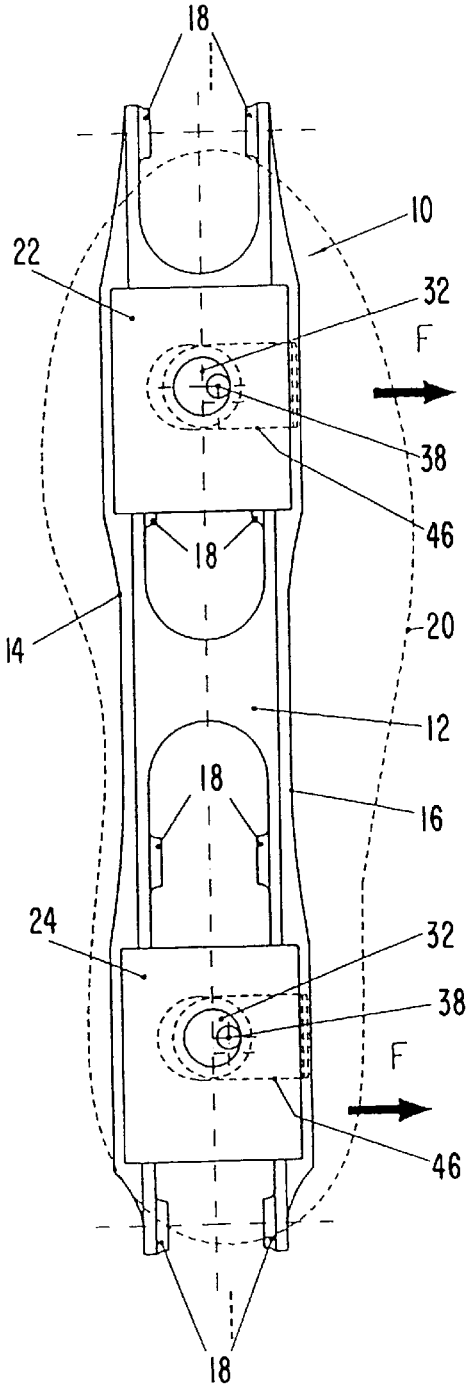
Figure 4:
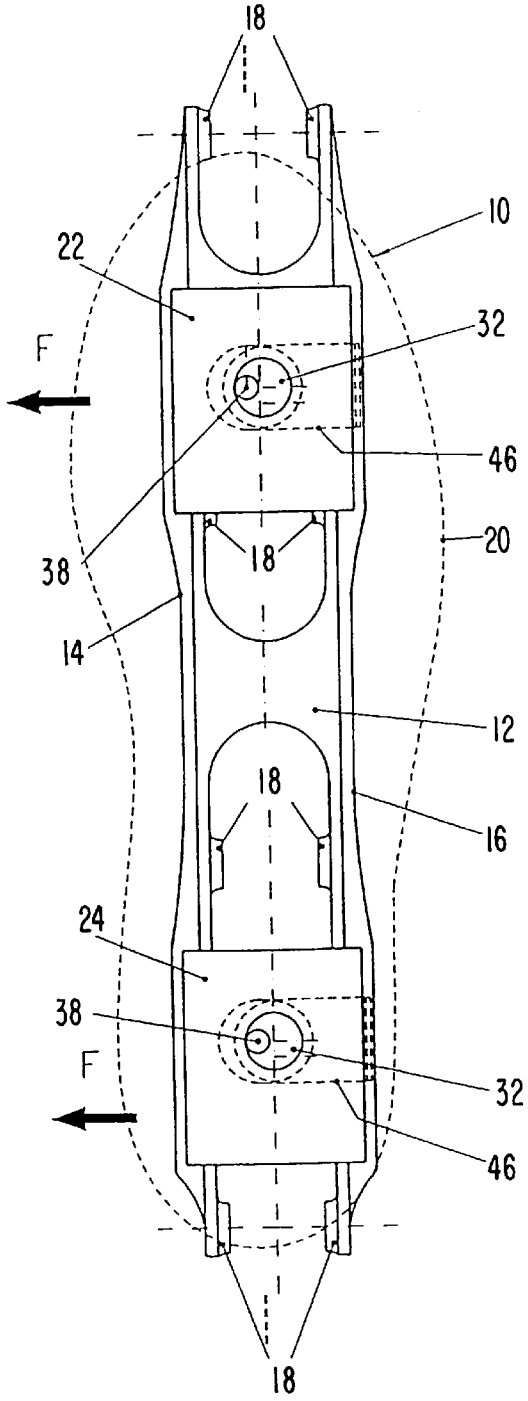
Figure 5:
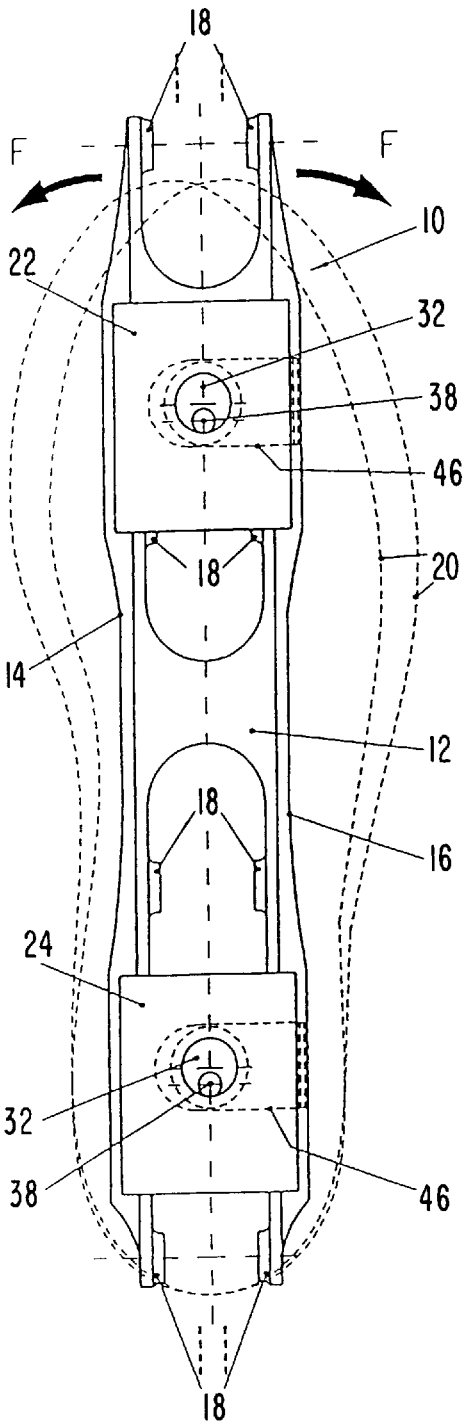
Figure 6:
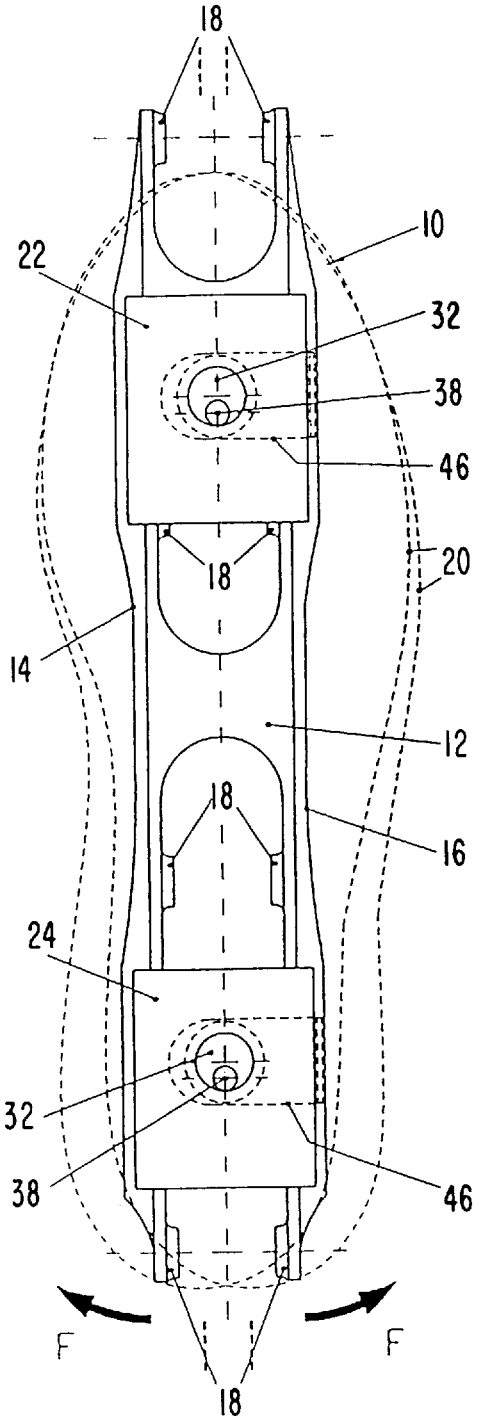
Figure 7:
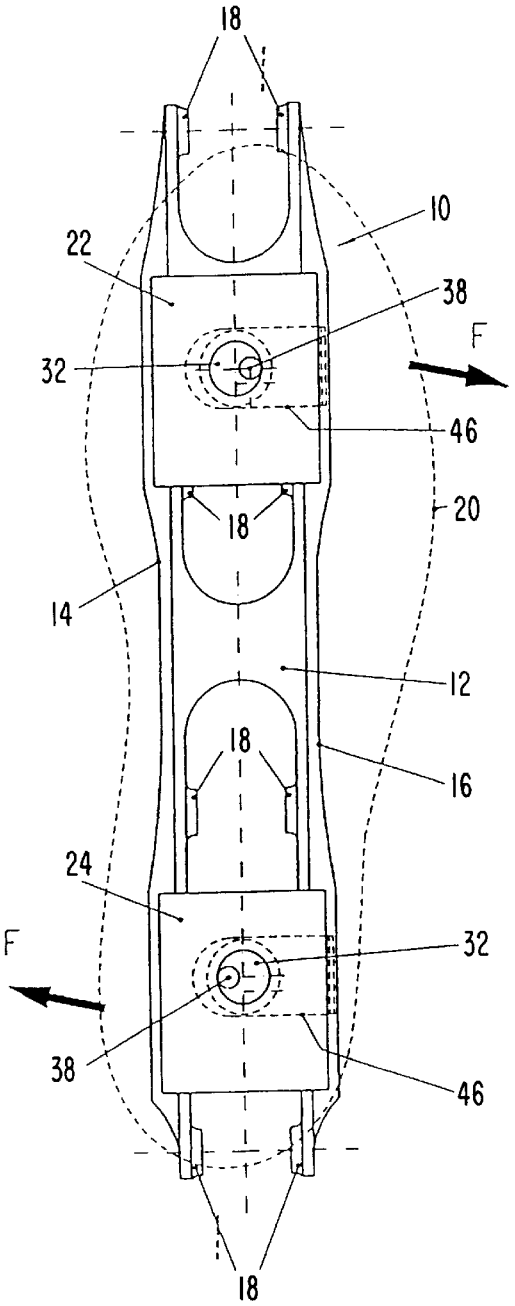
Figure 8:
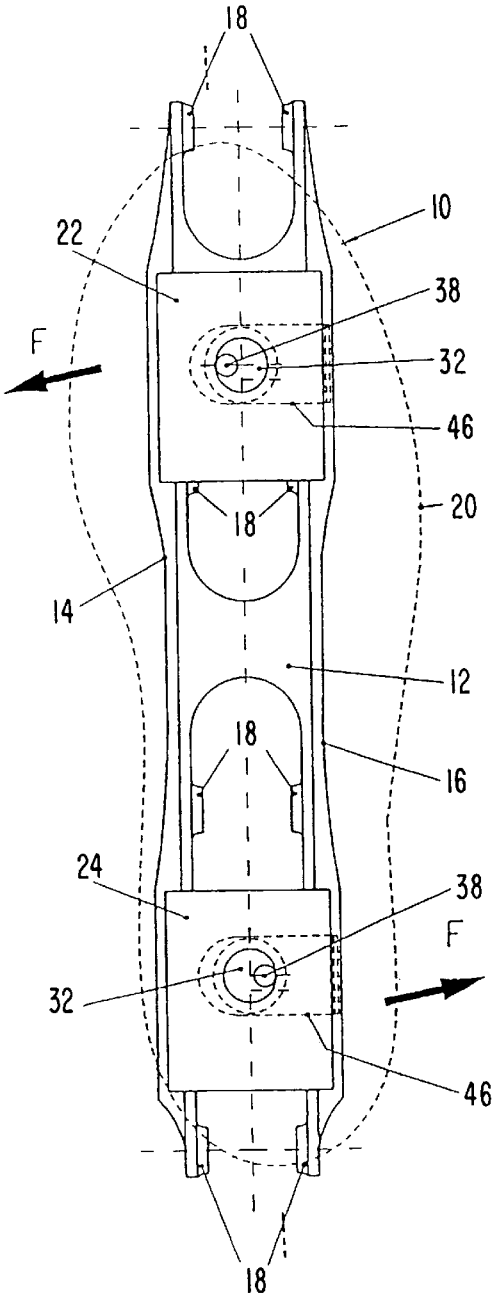
Figure 12:
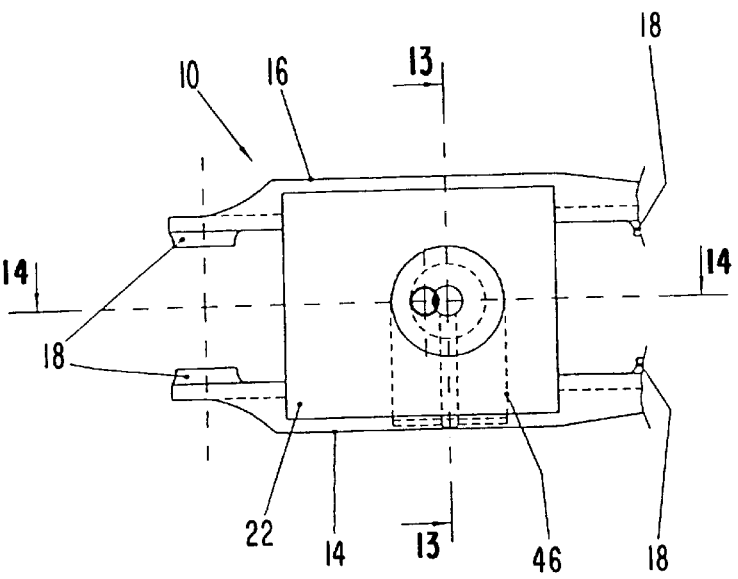
FIG. 12 is a plan view of the front end of the roller-carrying carriage in the first embodiment.

In particular, as stated above:

FIG. 1 illustrates a movement of the shoe 20 in the direction towards the front end of the skate 10;

FIG. 2 is an analogous drawing illustrating a movement in the opposite direction, that is to say, towards the rear;

FIG. 3 illustrates a side or transverse movement towards the right;

FIG. 4 represents a movement in the opposite direction, that is to say, towards the left;

FIG. 5 represents a clockwise or anticlockwise rotation of the front end of the shoe 20 relative to the carriage 10;

FIG. 6 is a view representing an analogous movement of the rear end of the shoe;

FIG. 7 illustrates a clockwise rotation of the shoe 20 relative to the skate 10;

FIG. 8 is a view analogous to FIG. 7 representing a rotation in the opposite sense, that is to say, an anticlockwise rotation.

Referring now also to FIGS. 9 to 14, it will be noted that the carriage 10 is provided, in each of the substantially stationary cross-members 22, 24, with an element for connecting those cross-members 22, 24 to the rigid sole of the footwear 20, the front end of which, shown in particular in FIGS. 9 and 14, is generally indicated as 26.

A description will now be given hereinafter of the releasable locking means by means of which the footwear 20 is fastened to the carriage 10, referring especially to FIGS. 9 to 14 but naturally bearing in mind also FIGS. 1 to 8. The detailed description of those fastening means will be given with reference to the front stationary cross-member 22 but it will be appreciated that the analogous means for connecting the cross-member 24 to the sole of the footwear 20 are substantially identical and therefore their representation and description are superfluous.

Figure 13:
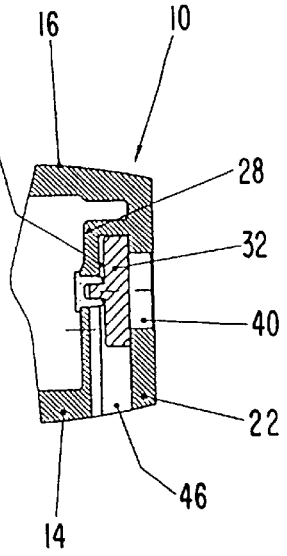
FIG. 13 is a view of the front end of the skate on section B—B of FIG. 12.

Referring first of all especially to FIGS. 13 and 14, it can be seen that the cross-member 22 has, on its lower face, that is to say, that facing the inside of the carriage 10, a substantially cylindrical and internally hollow projection generally indicated 28 which delimits, with the lower face of the cross-member 22, a substantially cylindrical seat 30, the inside of which accommodates a discoidal element 32 which has a substantially circular contour and which, according to one of the main features of the present invention, is connected eccentrically to the sole 26 of the footwear 20.

The discoidal element 32 has, at the bottom, a central pin 34 which is inserted in a freely rotatable manner in a suitable seat of a screw or dowel 36 screwed onto the lower face of the projection 28. Thus, when the discoidal element 32 is released as described hereinafter, it becomes disengaged from the cross-member 22, given that the seat 30 in which it is accommodated is slightly deeper than it is, and it can rotate freely inside the seat 30 about the longitudinal axis of the pin 34.

According to a further basic feature of the present invention, the discoidal element 32 is connected eccentrically, as explained hereinafter, to the sole 26 of the footwear 20.

The above-mentioned connection, in the embodiment shown in more detail in FIGS. 9 to 14, comprises a pin 38 having a non-threaded portion 41 which is introduced into an opening 40 in the cross-member 22 until its threaded end 39 is screwed into a corresponding hole in the discoidal element 32.

As can be seen especially in FIGS. 11 and 14, the longitudinal axis of the hole in the discoidal element 32 is substantially parallel with that of the pin 34. Thus, the connection between the pin 38 and the discoidal element 32 is of a substantially eccentric type and, as will be explained hereinafter, the connection permits all of the movements shown by way of example in FIGS. 1 to 8 and also the intermediate movements not specifically represented, as will be explained hereinafter.

To be more precise, as is shown in more detail in FIGS. 9 and 14, the pin 38 is applied to the cross-member 22 of the carriage 10 of the skate, in particular to the discoidal element 32, by passing through the opening 40 in the cross-member 22, by means of the interposition of a washer 42 which has a central hole 43 for the passage of the pin 38 and which is accommodated in a suitably shaped seat 44 in the sole 26 of the footwear 20. Of course, that embodiment is not to be regarded as limiting the invention because the application of the pin 38 to the discoidal element 32 in order to lock it and release it can be effected in another, equivalent manner.

It is important to underline the fact that the non-threaded portion 41 of the pin 38 is inserted into the holes 43 and 45 of the washer 42 and of the seat 44 in such a manner that it can rotate and move only axially. That connection enables the end 39 of the pin 38 to be screwed into the discoidal the element 32 and, when the element 32 is released relative to the cross-member 22, all of the movements imparted to the sole 26 are transmitted to the element 32 until the desired position of the sole 26 relative to the carriage 10 has been reached. It will therefore be appreciated that the rotations of the discoidal element 32 are converted into corresponding movements of the sole 26 owing also to the simultaneous movement of the non-threaded portion 41 of the pin 38 in the opening 40 of the cross-member 22.

As explained above, the rear end or at least the rear portion of the sole of the footwear 20 is connected in an entirely analogous manner to the rear cross-member 24 in which, in FIGS. 1 to 8, the same elements are indicated with the same reference numerals.

Referring now in particular to FIG. 13, 46 indicates a suitably shaped slot extending from the wall 14 of the carriage 10 as far as the region of the seat 30 accommodating the discoidal element 32. The slot 46 is provided purely to enable the discoidal element 32 to be introduced as far as the above-mentioned seat 30. It will be appreciated that the introduction opening of the slot 46 could be closed, at any rate for reasons of a purely aesthetic nature, by the application of an insert or the like (not shown) which is introduced into the slot 46 to mask it and, at the same time, to permit rotation of the discoidal element 32, when required, in order to adjust the position of the sole 26 and the carriage 10 relative to one another.

The functioning of the skate according to the present invention is clear from the above detailed description of its structure. The main methods by which the adjustment discussed above is carried out will in any case be explained hereinafter.

Purely by way of example, the starting point will be assumed to be the state of FIG. 1 which illustrates the footwear 20 in its position of maximum advance towards the front end of the skate and which state is clarified by referring to FIG. 14, and it will be assumed that the locking and positioning means associated with the rear cross-member 24 are in states equivalent to those of the corresponding means associated with the cross-member 22.

The arrows F of FIG. 1 indicate that that state or position can be achieved by moving the footwear 20 forwards relative to a different position, for example, one of those illustrated in FIGS. 2 to 8.

If the above-mentioned position is not satisfactory for the user, he has only to unscrew the threaded pins 38 to a limited extent in order to release the discoidal element 32 and render it freely rotatable.

Once he has carried out that operation, all he has to do, while maintaining the roller-carrying carriage 10 fixed in position, is to move the footwear 20 relative to the carriage 10 until he has brought it into a position which suits him better, the movement naturally being controlled by the eccentric connections described above.

At that stage of operation, in fact, the movement composed substantially of rotation and translation of the footwear 20 takes place and is assisted by the simultaneous rotation of the discoidal element 32 inside the seat 40 of the cross-member 22, 24, while the threaded pin 38, which is rotatable and moveable only axially relative to the sole 26, remains raised and rotates inside the hole 45 of the sole 26.

If, in particular, it is desired to move the footwear backwards from the position of FIG. 1 into that of FIG. 2, as indicated by the arrows F of the latter Figure, it is sufficient to cause the footwear to effect a curvilinear movement from the first to the second position while, at the same time, owing to the rotation of the discoidal element 32, the threaded pins 38 move from the position of FIG. 1 to that of FIG. 2 at 180° to the former.

Analogously, it is possible to obtain the positions shown in FIGS. 3 to 8 by means of suitable adjustment. Those Figures are self-explanatory and therefore require no further comment. It will be appreciated that any intermediate position whatever can be obtained in addition to the positions illustrated in detail in FIGS. 1 to 8, and that, as is clear from the description given above, adjustment is extremely quick and easy and, moreover, apart from permitting all possible positions, can be carried out rapidly. At the end of each adjustment, the pins 38 simply have to be screwed up again in order to lock the two discoidal elements 32.

The skate according to the present invention can, while maintaining its innovative concept unaltered and substantially the same, be produced in a variant described briefly hereinafter with reference to FIGS. 15 to 25. Purely for the sake of simplicity and brevity, the same component elements provided in the above-mentioned variant and corresponding to those of the first embodiment are indicated by the same reference numerals.

From a study of the Figures now under discussion, it will be noted that both of the discoidal elements associated with the stationary cross-members 22 and 24, and which are now marked by the reference 32A, are substantially polygonal and, in the non-limiting embodiment represented, they are more precisely octagonal, but it will be appreciated that a discoidal element 32A having a greater or lesser number of sides could achieve the same aim satisfactorily.

Figure 15:
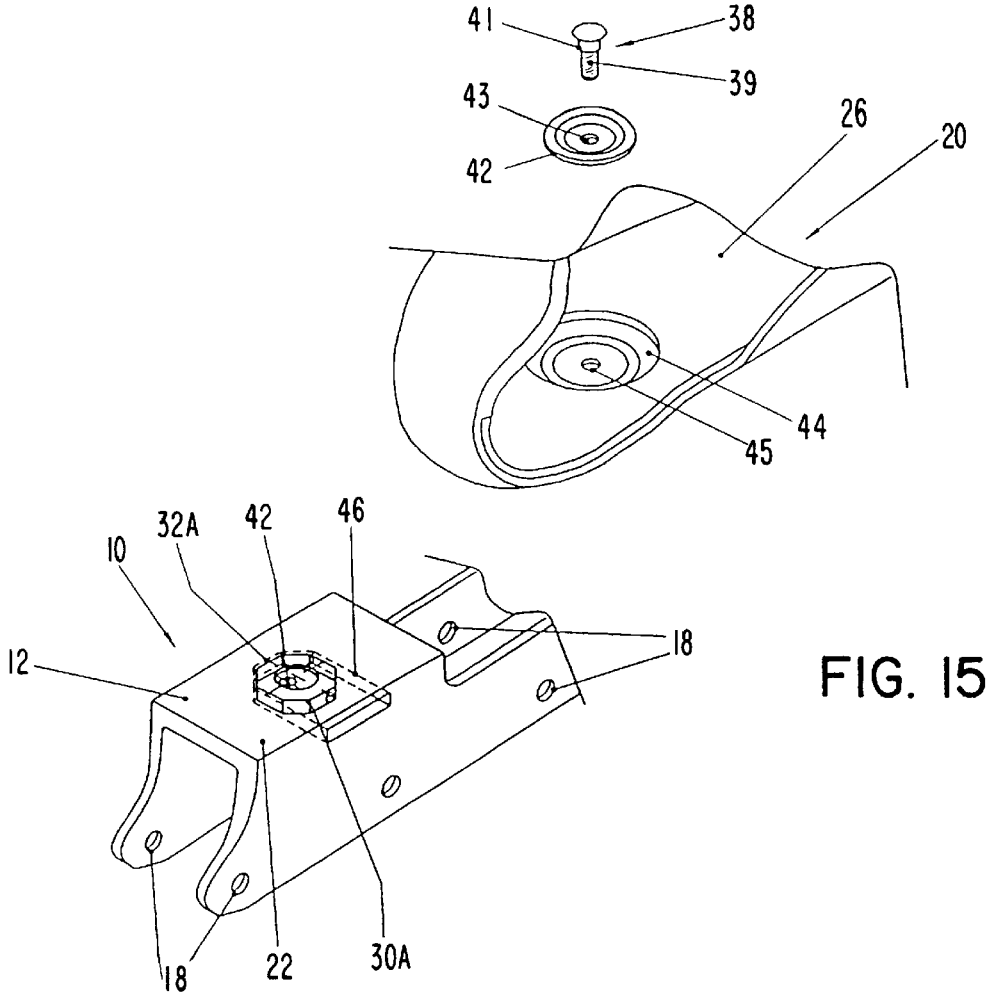
FIG. 15 is an exploded diagrammatic perspective view of the front end of a variant of the skate according to the present invention.
Figure 16:
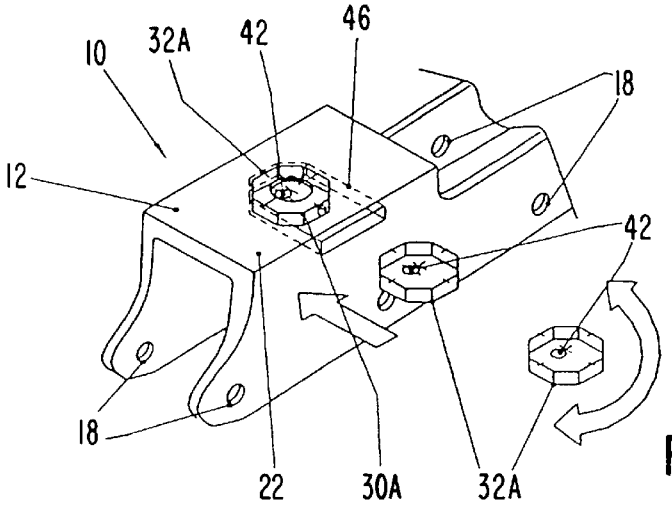
FIG. 16 is a view analogous to FIG. 15 of only the front end of the roller-carrying carriage in said variant.

As is shown especially in FIGS. 15 and 16, but referring also to the remaining FIGS. 17 to 25, it will be noted that the seats accommodating the discoidal elements 32A, which seats are now marked with the reference 30A, have a shape corresponding substantially to half of the contour of the discoidal element 32A so that the latter engages with the seat 30A with three of its consecutive sides while the two sides adjacent to the previous sides engage slidably with the walls of the slot 46 which, as stated above, enables the discoidal body 32A to be introduced as far as the seat 30A.

From what has been described above in relation to the variant of the skate according to the present invention, and referring now especially to FIGS. 17 to 25, the different positioning of the footwear relative to the carriage is substantially the same as the first embodiment. With reference to the above-mentioned Figures, it is sufficient to bear in mind that the change in the position of the footwear relative to the carriage of the skate is achieved in this case too by incompletely unscrewing the threaded pin 38 in order to free the discoidal element 32A which, once removed temporarily from the associated seat 30A of the cross-member 22 or 24, is reintroduced into that seat in a different position in order to change the position of the footwear relative to the carriage of the skate. Finally, as in the previous case, the discoidal element 32A is locked in its seat by screwing the threaded pin 38 completely back in.

Figure 17:
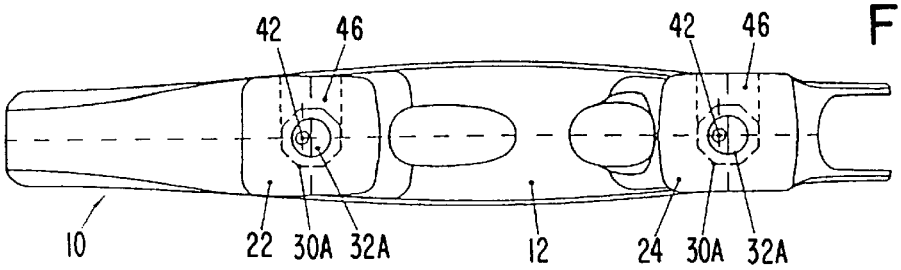
FIGS. 17 to 25 are diagrammatic plan views of the variant of the roller-carrying frame which show, as will be explained hereinafter, some of the various possible adjustments of the position of the footwear and the carriage relative to one another.
Figure 18:
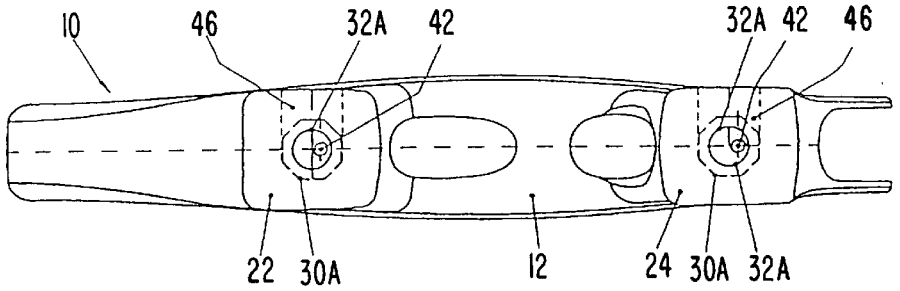
Figure 19:
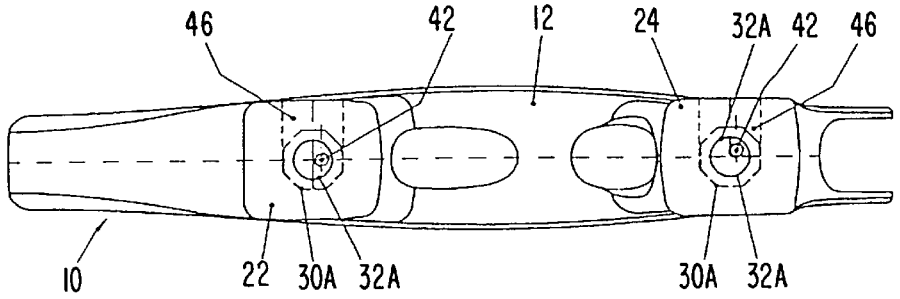
Figure 20:
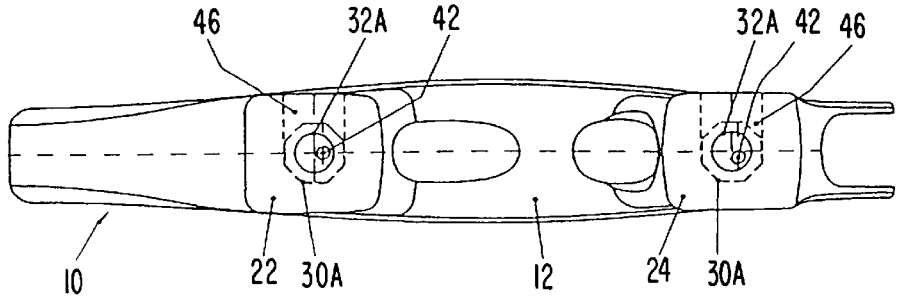
Figure 21:
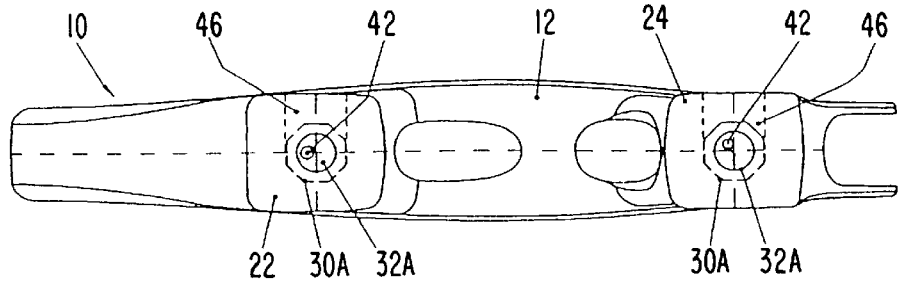
Figure 22:
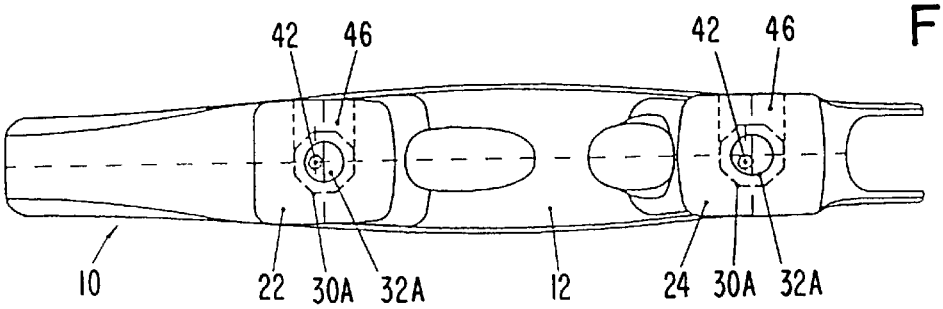
Figure 23:
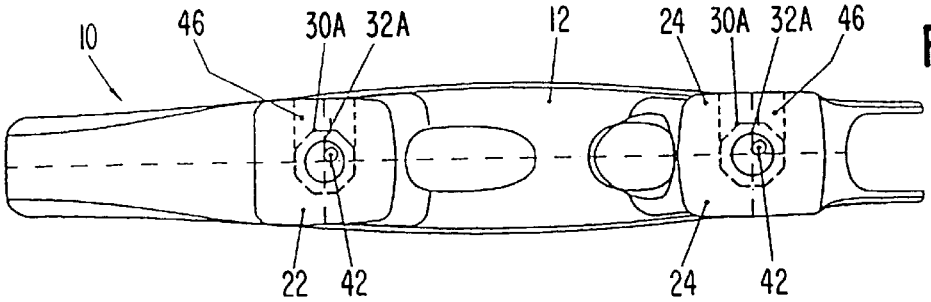
Figure 24:
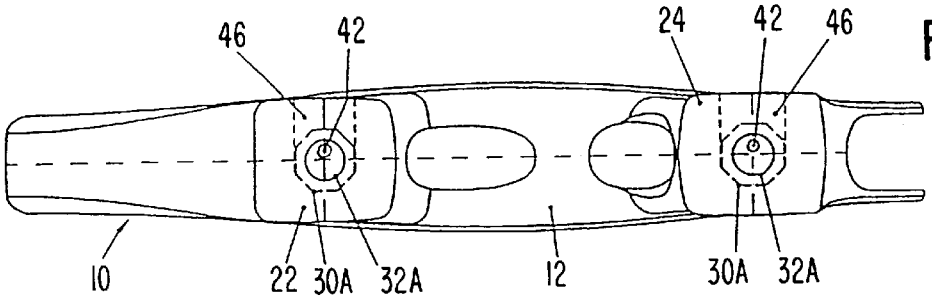
Figure 25:
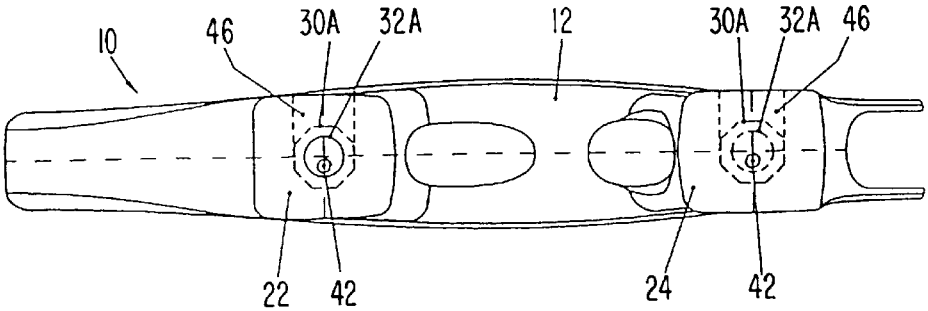

Referring now specifically to FIGS. 17 to 25 in which the footwear 20 is no longer represented, a list will now be given hereinafter, Figure by Figure, of some of the various possible adjustments and more precisely:

FIG. 17 illustrates a movement of the shoe in the direction towards the front end of the skate parallel with the median longitudinal axis of the carriage;

FIG. 18 is a Figure analogous to the previous Figure illustrating a movement in the opposite direction, that is to say, backwards towards the rear end;

FIG. 19 illustrates a clockwise rotation of the front end of the footwear relative to the front end;

FIG. 20 illustrates a rotation opposite to that of the previous Figure;

FIG. 21 illustrates a rotation of the footwear analogous to that of FIG. 19 with the footwear in an advanced position;

FIG. 22 illustrates a rotation that is symmetrical and opposite to that of FIG. 21;

FIG. 23 illustrates a rearward movement of the footwear in a plane parallel with the longitudinal plane of the carriage;

FIG. 24 illustrates a side movement parallel with the median longitudinal plane of the carriage and FIG. 25 illustrates a symmetrical movement of the footwear relative to that of FIG. 24.

It is clear from what has been described above that the change in the position of the footwear relative to the skate carriage in the variant is not continuous but variable by discrete values, the number of which of course depends on the number of sides of the discoidal element 32A and that embodiment naturally offers the advantage of stable positioning because the discoidal element 32A engages with some of its sides with corresponding sides of the associated seat in which it is accommodated.

The advantages of the skate according to the present invention are clear from what has been described above and therefore require no further comment.

Finally, it will be appreciated that variants and/or modifications that are equivalent in terms of structure and design could be introduced to the roller skate according to the present invention without departing from the scope of protection thereof.

It is worth confirming, however, that the innovative concept of the skate according to the present invention can be extended to any type of shoe with a rigid sole to the bottom of which an item of sporting equipment, such as, for example, as mentioned above, a bladed skate for ice-skating or a ski boot is fastened.

What is claimed is:

1. A roller skate comprising:

(1) a carriage (10);

(2) a series of freely rotatable rollers mounted on the carriage (10);

(3) a pair of substantially stationary cross-members (22, 24) mounted on the carriage (10); and (4) a fastening means on each of the cross-members (22, 24) for fastening the carriage (10) to a rigid sole (26) of a footwear (20) and having a discoidal element (32) for connecting the carriage (10) to the sole (26) and for, in a released configuration, repositioning the footwear (20) relative to the carriage (10), said discoidal element (32) being disposed within the cross-members (22, 24) and having a centrally located, rotation first pin (34) which can freely rotate on a first seat (36) relative to the cross-member (22, 24) and a connecting second pin (38) eccentrically offset relative to the first pin (34) for connecting to the sole (26) of the footwear (20).

2. A roller skate according to claim 1, wherein the second pin (38) for connection to the footwear (20) is releasably fastened to the discoidal element (32) and projects to an outside portion of the cross-member (22, 24) through an opening (40) in the latter for connection to the sole (26) of the footwear (20).

3. A roller skate according to claim 2, wherein an end (39) of the connecting second pin (38) is threaded and screwed into the discoidal element (32).

4. A roller skate according to claim 3, wherein the discoidal element (32) is accommodated in an internal projection (28) of the stationary cross-member (22, 24).

5. A roller skate according to claim 3, wherein a depth of the discoidal element (32) is slightly smaller than that of a second seat (30) of a projection (28) in which it is accommodated and that the discoidal element (32) can assume a locking position when a threaded end (39) of the second pin (38) is completely screwed into the discoidal element and a freely rotatable position when the threaded end (39) of the second pin (38) is unscrewed from the discoidal element (32).

6. A roller skate according to claim 1, wherein the second pin (38), when in a released state relative to the discoidal element (32), is rotatable together with that element about a longitudinal axis of the first pin (34), by moving in an opening (40) from which it projects from the cross-member (22, 24).

7. A roller skate according to claim 6, wherein a path of movement of the connecting second pin (38), in a released state, is substantially circular.

8. A roller skate according to claim 1, wherein the central rotation first pin (34) of the discoidal element (32) is formed integrally with that element.

9. A roller skate according to claim 1, wherein a portion of the connecting second pin (38) projecting from the cross-member (22, 24) of the carriage (10) is rotatable and moveable only axially inside a hole provided in the sole (26) of the footwear (20).

10. A roller skate according to claim 1, wherein the discoidal element (32) is substantially circular and a second seat (30) in which it is accommodated has a corresponding shape.

11. A roller skate according to claim 1, wherein the discoidal element (32) is substantially polygonal, and a second seat (30) in which it is accommodated is shaped correspondingly.

12. A roller skate according to claim 4, wherein the projection (28) of cross-member (22, 24) is arranged on an inner side of carriage (10).

* * * * *